US008025102B2

(12) United States Patent
Dewar

(10) Patent No.: US 8,025,102 B2
(45) Date of Patent: Sep. 27, 2011

(54) WELLBORE DELIVERY APPARATUS

(75) Inventor: John Dewar, Edinburgh (GB)

(73) Assignee: Swellfix BV, Rijswijk (NL)

( * ) Notice: Subject to any disclaimer, the term of this patent is extended or adjusted under 35 U.S.C. 154(b) by 148 days.

(21) Appl. No.: 12/142,249

(22) Filed: Jun. 19, 2008

(65) Prior Publication Data

US 2009/0200028 A1 Aug. 13, 2009

(30) Foreign Application Priority Data

Feb. 8, 2008 (GB) ..... 0802392.1

(51) Int. Cl.
*E21B 33/13* (2006.01)
*E21B 27/02* (2006.01)

(52) U.S. Cl. ..... 166/286; 166/165; 166/387; 166/153

(58) Field of Classification Search ..... 166/387, 166/179, 102, 162, 164, 165, 286, 292, 117
See application file for complete search history.

(56) References Cited

U.S. PATENT DOCUMENTS

| | | | | |
|---|---|---|---|---|
| 1,393,311 | A | 10/1921 | Pendleton | |
| 3,049,079 | A * | 8/1962 | Eilo | 102/324 |
| 3,159,219 | A | 12/1964 | Scott | |
| 3,187,813 | A | 6/1965 | Greene | |
| 4,191,254 | A * | 3/1980 | Baughman et al. | 166/286 |
| 4,378,050 | A | 3/1983 | Tatevosian | |
| 5,435,395 | A * | 7/1995 | Connell | 166/384 |
| 5,611,400 | A * | 3/1997 | James et al. | 166/293 |
| 5,657,822 | A * | 8/1997 | James et al. | 166/292 |
| 6,009,946 | A * | 1/2000 | McKelvey | 166/286 |
| 6,820,692 | B2 * | 11/2004 | James et al. | 166/292 |
| 2003/0150614 | A1 | 8/2003 | Brown | |
| 2007/0277979 | A1 | 12/2007 | Todd | |

FOREIGN PATENT DOCUMENTS

| | | |
|---|---|---|
| GB | 851700 | 10/1960 |

* cited by examiner

*Primary Examiner* — Kenneth L Thompson
(74) *Attorney, Agent, or Firm* — J. Scott McBride

(57) ABSTRACT

An apparatus for delivering a material into a wellbore comprises a body adapted to be translated along a conduit within a wellbore, with a cavity formed in the body for containing a material to be delivered. The body defines an outlet adapted to be selectively opened to permit the material to be released from the cavity at the required location within the wellbore. In one arrangement the material includes swellable particles which expand upon contact with an activator.

32 Claims, 4 Drawing Sheets

WELLBORE DELIVERY APPARATUS

CROSS-REFERENCE TO RELATED APPLICATIONS

This application claims benefit of United Kingdom patent application serial number 0802392.1, filed Feb. 5, 2008, which is herein incorporated by reference.

FIELD OF THE INVENTION

The present invention relates to an apparatus for delivering material into a wellbore, and in particular, but not exclusively, to an apparatus for delivering a swellable material into a wellbore, for example following or during a cementing operation.

The present invention also relates to a cement plug and a method of sealing a conduit within a wellbore.

BACKGROUND

The general procedure of forming a wellbore, such as an oil and gas wellbore, includes drilling a bore into the earth until the surrounding formation requires support or where the characteristics of the formation requires it to be sealed-off from the drilled bore. At this stage a length or string of tubing, conventionally called casing, is run into the formed bore and is cemented in place. The casing and cement are therefore utilized to support and seal the bore. If the bore is to be advanced then a smaller diameter drilling assembly is run through the cemented casing and the procedure is repeated until the required or total depth is reached. The resulting cased wellbore therefore has a stepped profile with the final casing string having a significantly reduced diameter.

Conventionally, a cement or casing shoe is mounted on the lower end of each casing string, wherein the shoe defines a rounded end which assists smooth running of the casing into the bore, and also incorporates flow passages which permit cement delivered through the casing to exit and flow into the annulus formed between the casing and the bore wall. A float collar is positioned one or two joints above the bottom of the casing string and contains a check valve to permit fluid to pass downward but not upward through the casing.

When the casing string is fully run into the drilled bore, a calculated volume of cement is displaced downwardly through the casing, through the cement shoe and into the annulus. Typically, the volume of cement is contained between lower and upper cement plugs and is displaced by a fluid, such as drilling mud, pumped from surface. The lower plug prevents contamination of the cement from fluids ahead of the cement, and the upper plug prevents contamination of the cement from the displacing fluid. During a cementing operation, the lower cement plug will eventually land on top of the float collar and increasing pressure will burst a disk in the lower plug opening a passage therethrough, permitting the top plug to displace the cement through the lower plug, float collar and cement shoe and into the annulus.

Following a cementing operation the internals of the float collar and cement shoe must be drilled through to advance the depth of the bore. However, such drilling imparts vibration and other mechanical forces into the cement surrounding the cement shoe which may therefore be adversely affected.

In certain cases, such as in offshore deepwater areas, for example in the Gulf of Mexico, the formation is particularly weak and requires many casing strings to be run in to ensure sufficient bore support and sealing. However, if many casing strings are required then the reduction in bore diameter will be significant, which is undesirable. In order to minimize significant bore size reductions attempts are made to utilize casing strings which are as close to the drilled bore diameter as possible, resulting in a reduced annulus area between the casing and the bore. However, a reduced annulus area creates higher circulating pressures that can break down the formation in view of the low formation fracture pressure and formation strength, which creates losses and adverse well control situations. It is known in the art to address this problem by underreaming the bore to make it larger to thus lower the circulation pressure. However, this action makes it more difficult to create a good and strong cement job, particularly around the casing shoe.

Further concerns in the oil and gas exploration and production industry relate to the delivery of materials, such as chemicals and the like, to specific regions of a wellbore. In many cases it is preferred that the material to be delivered is isolated from wellbore fluids, at least until the required location in the wellbore is reached. This may be achieved in the art by utilizing coiled tubing, for example, which is run into the wellbore to create an uncontaminated flow-path. However, running in coiled tubing and subsequently delivering fluid through the tubing is time consuming and requires a significant amount of dedicated space on a rig platform, which is at a premium.

SUMMARY

According to a first aspect of the present invention there is provided an apparatus for delivering a material into a wellbore, said apparatus comprising: a body adapted to be translated along a conduit within a wellbore; a cavity defined within the body and adapted to contain a material to be delivered; and an outlet formed in the body and adapted to be selectively opened to permit the material to be released from the cavity.

Accordingly, in use, the body may be filled with a material to be delivered into a wellbore and subsequently translated along a conduit within the wellbore to the required location, following which the outlet may be opened to permit the material to be released. Thus, the material being delivered may be isolated from the wellbore environment until the required location is reached.

The apparatus will typically be utilized to deliver a sealing material to a zone in a wellbore where sealing is required. The sealing zone may be an annulus between tubulars, or may be an annulus between a tubular and the wall of a drilled bore.

The body may be adapted to be translated along a conduit defined by an open borehole. Alternatively, or additionally, the body may be adapted to be translated along a conduit defined by one or more wellbore tubulars, such as casing tubulars, liner tubulars, coiled tubing, drilling tubulars, collars or the like.

It should be understood that the term "wellbore" as used herein relates to any portion of a bore, including portions which extend into the earth, such as a drilled bore, and portions located on the surface of the earth, such as pipelines, risers or the like.

The apparatus may comprise drive means adapted to drive the body along a conduit. The drive means may comprise a motor or the like. The apparatus may also comprise traction means adapted to displace the apparatus through a conduit. The traction means may be driven by the drive means. The traction means may comprise rotating bodies, tracks or the like.

The apparatus may form part of a tubing string, for example the body may comprise one or more casing joints.

Thus, the apparatus may be translated through the wellbore as a tubing string is made up and run into a bore.

In one embodiment the body may be adapted to be driven along a conduit by an external driving force. The external force may be at least partially provided by gravity, or may be at least partially provided by a member extending to surface, such as coil tubing, or a drill pipe string. The external driving force may be at least partially established by fluid pressure within the conduit. In this arrangement the body may be adapted to be pumped or displaced through a conduit by a driving fluid. The driving fluid may be, for example, drilling mud, water, hydrocarbons or the like.

The body may be configured to have an external dimension similar to an internal dimension of a wellbore conduit within which the apparatus is to be used or translated. This may therefore permit efficient transportation of the apparatus through the conduit utilizing a driving fluid. In this arrangement the apparatus may be adapted to be pushed through the conduit by a driving fluid, without significant losses of fluid pressure by leakage past the apparatus.

The apparatus may further comprise at least one resilient member extending from the outer surface of the body, wherein said resilient member is adapted to engage an inner surface of the wellbore conduit within which the apparatus is to be used. Accordingly, the resilient member may establish a resilient seal between the body and the wall of the conduit, minimizing leakage of, for example, driving fluid past the body. Furthermore, the resilient member may function to wipe the inside of the conduit. The resilient member may comprise a fin or the like and may be generally annular in form. The resilient member may comprise an elastomer material, such as rubber or the like. A plurality of resilient members may be utilized.

The apparatus may further comprise a barrier mounted within the outlet, wherein the barrier is adapted to be at least partially removed to selectively open the outlet. The barrier may comprise a disk, diaphragm, valve member, such as a flapper valve, or the like.

The barrier may be adapted to be removed in response to an applied force or pressure. An applied force may be applied by a member dropped or otherwise delivered from surface, or by a member extending to surface, such as coil tubing. In other arrangements the barrier may be adapted to be ruptured, fractured, sheared, displaced or the like by application of pressure. The pressure may be applied externally of the body, or alternatively, or additionally, internally of the body.

The apparatus may comprise a release mechanism adapted to selectively remove the barrier. The release mechanism may comprise a latch mechanism, piston arrangement or the like.

The apparatus may be adapted to eject the material from the cavity in response to a predetermined condition which may be related to a pressure condition, temperature condition, time lapse condition or the like.

The apparatus may be adapted to eject material from the cavity through the outlet when said outlet is opened. The apparatus may comprise an ejecting mechanism, such as a piston arrangement or the like for ejecting material from the cavity.

The apparatus may further comprise an inlet formed in the body adapted to permit access into the cavity. In one embodiment the outlet may also function as the inlet. Alternatively, or additionally, the inlet may be provided separately from the outlet. The inlet and outlet may be positioned opposite each other. In one embodiment the inlet and outlet may be aligned along a central axis of the body.

The inlet may be adapted to be selectively opened to permit access into the cavity. The inlet may selectively permit fluid communication between the cavity and the wellbore conduit within which the apparatus is located. In this arrangement the inlet may permit fluid from a wellbore to enter the cavity to eject or flush the material from the cavity through the outlet. In one embodiment the inlet is adapted to permit a driving fluid used to drive the apparatus along a wellbore conduit to communicate with the cavity. Accordingly, in embodiments of the invention the driving fluid may also be used to eject the material from the cavity through the outlet.

The inlet may permit fluid communication into the cavity to expose a barrier formed in the outlet to fluid pressure or to allow a fluid pressure induced force to be applied to the barrier. The fluid pressure may be utilized to at least partially remove the barrier to permit material within the cavity to be ejected through the outlet.

The apparatus may further comprise a barrier mounted within the inlet, which barrier may be adapted to be moved or at least partially removed to selectively open the inlet. The barrier may comprise a disk, diaphragm, valve member, such as a flapper valve, or the like.

The barrier may be adapted to be moved or removed in response to an applied force or pressure. In one arrangement the barrier may be adapted to be ruptured, fractured, sheared, displaced or the like by application of pressure. The pressure may be applied externally of the body, or alternatively, or additionally, internally of the body.

The apparatus may further comprise a pressure compensator adapted to substantially equalize the pressure of the cavity with the pressure within the wellbore conduit. The pressure compensator may comprise a piston arrangement or the like, and one or more pistons may be arranged to close one or both of the inlet and the outlet.

The apparatus may be adapted to be located at a required location within a wellbore conduit by engagement with a restriction within said conduit. For example, the apparatus may be adapted to engage a landing nipple, a float collar, a plug, a downhole tool or the like. In one embodiment the apparatus may be adapted to be driven through a wellbore conduit by a driving fluid, wherein engagement of the apparatus with a restriction within the conduit will effect an increase in the pressure of the driving fluid. This increasing pressure may cause at least one or both of the inlet and the outlet to be opened to permit release of the material being delivered.

The apparatus may be adapted to deliver any required material into a wellbore conduit, such as cement, hydraulic fluid, an explosive mixture, a packer material, a chemical composition, lost circulation material (LCM), a hardener material, a reactant, a catalyst material or the like, or any suitable combination of materials. Where a combination of materials is provided, the materials may be pre-mixed or may be separated. Separated materials may be adapted to be remain separated during or following ejection from the cavity, or may be arranged to mix or otherwise interact as the materials during or following ejection.

In one preferred embodiment the apparatus may be adapted to deliver a swellable material to a required location within a wellbore conduit. The swellable material may be in the form of slurry, foam or the like. Alternatively, the swellable material may comprise swelling particles. Accordingly, the swellable material may be located within the cavity of the body, and the apparatus subsequently driven through a wellbore conduit to the required location, following which the swellable material may be ejected from the cavity and subsequently caused to swell when exposed to a suitable activator. In embodiments where the material comprises swellable particles, the particles may be adapted to swell when exposed to a common activator. Alternatively, different particles may be adapted to swell when exposed to different activators, or to swell at different rates or otherwise have different swelling characteristics. The activator may comprise a chemical activator, thermodynamic activator, fluid dynamic activator or the like, or any suitable combination thereof. For example, the activator may comprise a fluid, such as water, hydrocarbons, cement, drilling mud or the like, or any suitable combination thereof. The activator may comprise one or more ambient fluids present within the wellbore. Alternatively, the activator may comprise a fluid delivered from surface. For example, the driving fluid used to drive the apparatus through the wellbore conduit may comprise a suitable activator. Alternatively, or additionally, the activator may be delivered into the wellbore by a further apparatus according to the present invention.

In embodiments where a swellable material is delivered into a wellbore, the swellable material may advantageously be isolated from any wellbore fluids which may otherwise cause the swellable material to swell while being delivered into the wellbore. This therefore prevents the swellable material expanding and becoming trapped within or blocking or restricting the wellbore conduit at an undesired location.

Furthermore, isolating the swellable material within the cavity until the desired location is reached will advantageously prevent the material from being coated with a fluid which may prevent or restrict swelling of the material. For example, a swellable material which is adapted to swell in water may become coated in hydrocarbons which may establish a film or barrier preventing sufficient exposure of the material to water in order to be activated.

The apparatus may be adapted to deliver a material comprising swellable particles of different sizes. The different sized particles may be mixed together within the cavity. This arrangement therefore simplifies the process of filling the cavity. Alternatively, the particles may be contained in defined layers or regions within the cavity. The swellable particles may be appropriately graded such that the larger particles are first ejected from the outlet, followed by smaller particles. In use, the larger particles may be utilized to establish a barrier within the wellbore which prevents the smaller particles from being displaced to an undesired location.

In embodiments of the invention the apparatus may be utilized in combination with a wellbore barrier adapted to retain the material in the desired location within the wellbore when the material is released from the cavity. The barrier may comprise a mesh material or the like. The barrier may be formed as a separate component and positioned within the wellbore. Alternatively, or additionally, the barrier may be formed as an integral part of an existing wellbore apparatus or the like, such as a centralizer, packer or the like.

In one embodiment the apparatus may be adapted to deliver material into an annular area located within a wellbore, such as an annulus formed between a wellbore tubular and a wall surface of a wellbore. The apparatus may therefore be utilized to establish a packer in situ within a wellbore.

The apparatus may be adapted to deliver a swellable material into an annulus surrounding a casing or cement shoe. This arrangement may advantageously assist to ensure that a reliable seal may be achieved at this location which is known in the art to be problematic.

The swellable material may be selected such that the material does not degrade or dissolve in the activating or ambient fluids, and thus may be utilized to form a permanent seal.

The apparatus may be adapted to be translated through a wellbore conduit, such as a casing string, leading or following a volume of cement which is displaced through the wellbore conduit and into a wellbore annulus. In this arrangement material within the cavity of the apparatus may be released before or following displacement of the cement into the annulus. The apparatus may therefore be utilized as part of, prior to, or subsequent to a cementing operation.

The apparatus may function as or form part of a cement plug.

According to a second aspect of the present invention there is provided a method of delivering a material into a wellbore, said method comprising the steps of: providing an apparatus having a body and a cavity defined within the body; loading a material into the cavity; locating the apparatus into a wellbore conduit and translating said apparatus to a required location within the conduit; and releasing the material from the cavity.

The apparatus may be in the form of an apparatus according to the first aspect and the features and methods of use of the apparatus identified above in relation to the first aspect may be applied to the method of this second aspect.

The material may be released from the cavity through an outlet adapted to be selectively opened. The outlet may be selectively opened by application of pressure.

The apparatus may form part of a tubing string, and may be translated into a bore as the string is made up and run into the bore. For example, the body may comprise one or more joints of casing, and the cavity may thus be of a large volume.

The method may comprise the step of driving the apparatus through the wellbore conduit using a driving fluid. The driving fluid may comprise drilling mud, water or the like, or any suitable combination of fluids.

The method may comprise the step of driving the apparatus through a wellbore conduit until engagement with a restriction within the conduit. The restriction may comprise a float collar, landing nipple, another apparatus, a plug or the like. Furthermore, the method may comprise the step of releasing the material from the cavity subsequent to engagement of the apparatus with the restriction.

The method may comprise the step of utilizing the driving fluid to release the material from the cavity. In this arrangement the driving fluid may flush or eject the material from the cavity.

The apparatus may comprise an inlet formed on the body and adapted to permit access to the cavity. The inlet may permit selective fluid communication between the wellbore conduit and the cavity. In one embodiment the method may comprise the step of selectively opening the inlet to permit fluid communication of the driving fluid with the cavity, wherein the driving fluid may subsequently eject or flush the material from the cavity through the outlet.

The method may comprise the step of releasing the material and displacing this into an annular area formed within the wellbore, such as an annulus formed between the wellbore conduit and a wall of the wellbore.

The material being delivered may comprise a swellable material, which may be in the form of slurry, foam or the like. Alternatively, the swellable material may comprise swelling particles. The swelling particles may be adapted to swell when in contact with an activator, such as a fluid activator. The activator may be comprised in the driving fluid, or alternatively, or additionally may be comprised in ambient wellbore fluids. In other embodiments the activator may also be contained within the cavity, or within another apparatus, but initially isolated from the swelling material.

The method may comprise the step of loading swellable particles of different sizes into the cavity. The swellable particles may be loaded in accordance with the size of the particles. In one arrangement the swellable particles are loaded within the cavity such that the particles of larger size are released first, followed by smaller particles. In this arrangement the larger particles may be released at the desired location and therefore establish a barrier to prevent displacement of the smaller particles towards an undesired location.

According to a third aspect of the present invention there is provided a cement plug comprising: a body adapted to be driven through a wellbore conduit; a cavity formed within the body and adapted to contain a material; and an outlet formed in the body and adapted to be selectively opened to permit the material to be released from the cavity.

The cement plug may comprise similar or identical features of the apparatus described above in relation to the first aspect.

The cement plug may be adapted for use as an upper cement plug. It will be understood by those of skill in the art that an upper cement plug is a plug that follows or trails a volume of cement displaced through a wellbore conduit, such as a casing string. However, the cement plug may also be adapted for use as a lower cement plug, which is understood to be a cement plug which leads a volume of cement. Methods in accordance with embodiments of the invention may involve use of two plugs of this aspect of the invention, one leading and one following a volume of cement. Alternatively, the cement plug may be placed anywhere in the cement volume.

According to a fourth aspect of the present invention there is provided a method of sealing a conduit within a wellbore, said method comprising the steps of: providing an apparatus having a body and a cavity defined within the body; loading a sealing material into the cavity; locating the apparatus within a conduit in a wellbore and translating said apparatus to a required location within the conduit; and releasing the sealing material from the cavity and displacing the material into an annulus formed between the conduit and the wellbore.

The apparatus may be in the form of an apparatus according to the first aspect and the features and methods of use of the apparatus identified above in relation to the first aspect may be applied to the method of this fourth aspect.

The sealing material may comprise cement or another sealing material, or a component of a sealing material. Alternatively, or additionally, the sealing material may comprise a swellable material. The swellable material may be adapted to swell when exposed to an activator, such as water, hydrocarbons, cement, mud or the like. Accordingly, the method may comprise the step of displacing the swellable material into the annulus and then activating the swellable material to swell to establish a seal within said annulus.

The method may comprise the step of introducing a volume of cement into the conduit and displacing the cement through the conduit using the apparatus, wherein the cement is displaced into the annulus between the conduit and the wellbore. In this arrangement the cement may be displaced through a cement shoe located at a lower end of the conduit.

Prior or subsequent to locating the cement in the annulus, the sealing material may be released from the cavity and displaced into the annulus to be activated to form a seal. Thus, the sealing material may establish a seal in the annulus surrounding the upper end of a section of conduit or surrounding the cement shoe and/or the lower end of the conduit, or at any desired position in the cement column. Accordingly, the present invention permits a robust seal to be established at these locations, which conventionally suffers poor sealing integrity.

The method may comprise the step of driving the apparatus through the conduit using a driving fluid, such as drilling mud, water or the like. The driving fluid may comprise an activator adapted to cause swellable material contained within the apparatus to swell. The driving fluid may be displaced through the conduit utilizing a plug or other suitable apparatus.

BRIEF DESCRIPTION OF THE DRAWINGS

These and other aspects of the present invention will now be described, by way of example only, with reference to the accompanying drawings, in which.

DESCRIPTION OF EMBODIMENT(S)

Figure 1:
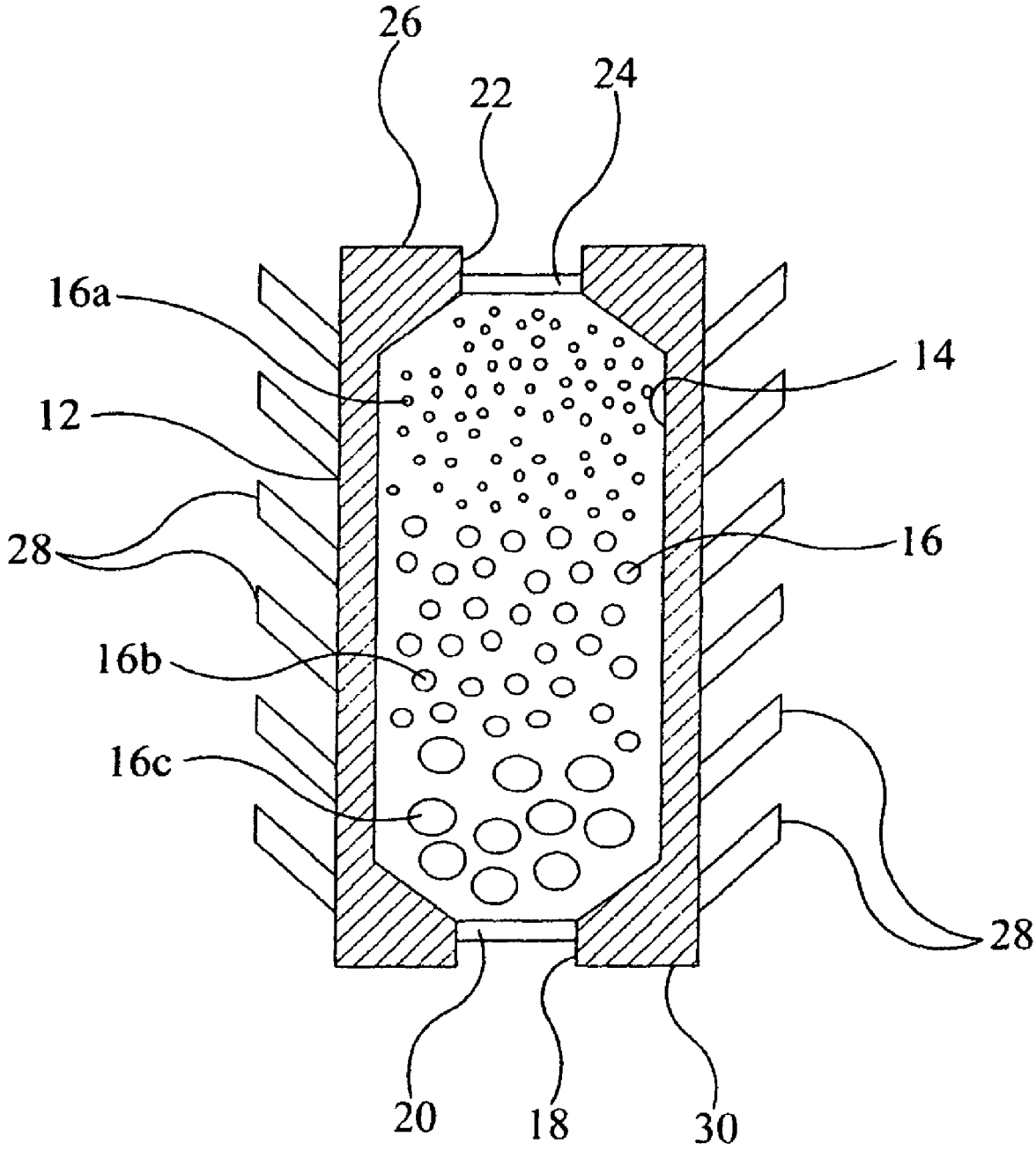
FIG. 1 is a diagrammatic cross-sectional view of an apparatus according to an embodiment of an aspect of the present invention.

FIG. 1 is a diagrammatic cross-sectional view of an apparatus, generally identified by reference numeral 10, which is adapted for use in delivering a material into a wellbore, such as an oil and gas wellbore. The apparatus 10 comprises a body 12, which can be formed of a metal such as an aluminum alloy, wherein a cavity 14 is defined within the body 12. The cavity 14 is adapted to contain a material 16 which is to be delivered into a wellbore. The apparatus 10 further comprises an outlet 18 formed in the body 12, wherein a lower frangible disk 20 is positioned within the opening 18 to seal the material 16 within the cavity 14. An inlet 22 is also formed in the body 12 and an upper frangible disk 24 is mounted within the inlet 22.

In use, the cavity 14 may be filled with the material 16 through either the inlet 22 or outlet 18, with the cavity 14 subsequently being sealed by securing the lower and upper disks 20, 24 in place. Following this the entire apparatus 10 may be inserted into a wellbore, such as an open hole wellbore, cased wellbore or other wellbore tubular, and subsequently translated through the wellbore until the required location is reached. In the embodiment shown the apparatus 10 is specifically adapted to be driven through a wellbore by use of a driving fluid which will act against the upper surface 26 of the body 12. It should be noted that the apparatus 10 further comprises a plurality of annular fins 28 which extend from the outer surface of the body 12 and in use are adapted to engage the inner surface of a wellbore. Accordingly, the fins 28 permit a resilient seal to be established between the body 12 of the apparatus 10 and the inner wall surface of the wellbore. This therefore prevents or at least minimizes the leakage of any driving fluid past the body 12 which therefore maximizes the efficiency of transportation of the apparatus 10 through the wellbore.

The apparatus 10 may be located at the required position within a wellbore by engagement of the lower surface 30 of the body 12 with a restriction within the wellbore, such as a collar, landing nipple, no-go, plug member or the like. Once the apparatus 10 has landed on the appropriate wellbore restriction then the pressure of the driving fluid will be increased until the upper disk 24 is sheared, burst or the like to therefore permit entry of the driving fluid into the cavity 14. Fluid pressure within the cavity 14 will eventually result in the lower disk 20 being sheared, burst of the like at which point the driving fluid will displace or wash the material 16 from the cavity 14 via the outlet 18 to therefore be dispersed at the required location within the wellbore.

The apparatus 10 therefore permits the material 16 to be isolated from the wellbore environment until the required location within the wellbore has been reached, at which point the material 16 may be released. This arrangement is particularly advantageous when the material 16 may adversely react with the wellbore environment.

In the particular embodiment shown, the material 16 comprises particles of a swellable elastomer which swell when they come into contact with a particular activator, such as a fluid activator, for example, water or hydrocarbons. Thus, the apparatus 10 permits the swellable particles 16 to be completely isolated from any wellbore fluids which may otherwise cause the particles to swell at an undesired location, until the desired location is reached when the swellable particles may be ejected or flushed from the cavity 14 into the desired wellbore region and thereafter caused to swell. It should be noted that in the embodiment shown the swellable particles 16 are composed of small grain size particles 16*a*, medium grain size particles 16*b* and large grain size particles 16*c*. The particles 16*a*, 16*b*, 16*c* are shown in the Figures arranged in layers within the cavity 14. However, this is for clarity purposes only and it should be understood that any arrangement, such as a mixed arrangement, might be utilized. The advantages of using different sized swellable particles 16 will become apparent from the following description.

A particular use of the apparatus 10 shown in FIG. 1 will now be described with reference to FIGS. 2 and 3 in which there is shown a lower end region of a wellbore 32 and a casing string 34 being cemented in place within the wellbore 32.

Figure 2:
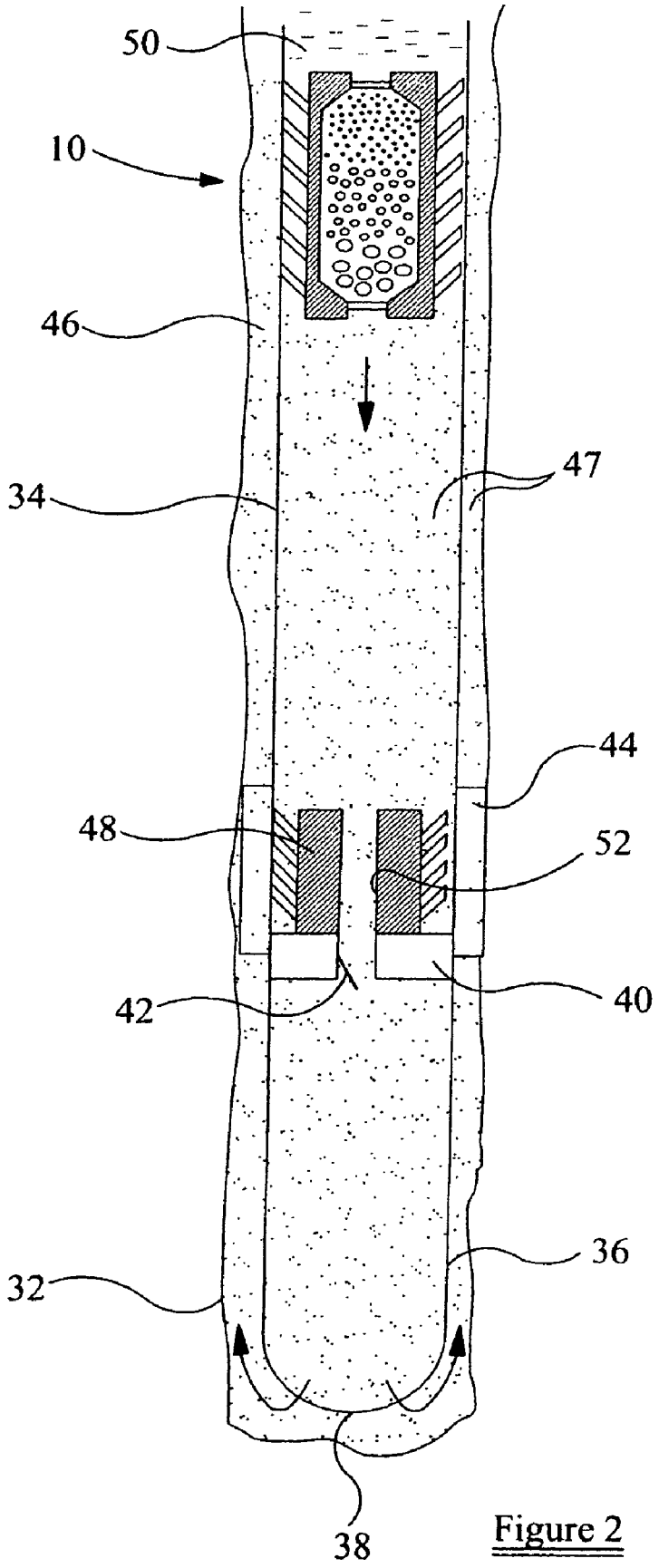
FIG. 2 is a diagrammatic representation of the apparatus of FIG. 1 in use within a wellbore.

Referring initially to FIG. 2, a conventional cementing operation is represented which utilizes the apparatus 10 of the present invention, wherein the apparatus 10 is used as an upper cement plug.

The casing string 34 comprises a casing shoe 36 which includes a rounded end 38 which assists insertion of the casing string 34 into the wellbore 32. A float collar 40 is positioned above the casing shoe 36, wherein the float collar 40 incorporates a flapper valve 42. The flapper valve 42 is configured to permit fluids to be displaced downwardly through the casing while preventing fluids to be displaced upwardly through the casing 34.

A tubing centralizer 44 is mounted on the external surface of the casing string 34 and functions to centralize the casing string 34 relative to the wellbore 32.

When the casing string 34 is fully run into the wellbore 32, a volume of cement 47 required to fill the annulus 46 formed between the casing 34 and wellbore 32 is introduced into the casing string 34 to be displaced therethrough.

The cement volume 47 is located between a lower cement plug 48 and an upper cement plug, which in the embodiment shown is provided by the apparatus 10. The upper and lower plugs 10, 48 therefore prevent the cement 47 from being contaminated by any other fluids contained within the casing 34. In other embodiments of the invention the apparatus 10 may provide the lower plug 48, or the apparatus 10 may provide both plugs, or the apparatus 10 may be utilized in addition to the upper and lower plugs.

Once the cement 47 and upper and lower plugs 10, 48 are located within the casing 34, a driving fluid 50 is utilized to displace the plugs 10, 48 and cement 47 downwardly through the casing string 34. The lower plug 48 will eventually land on top of the float collar 40, and increasing pressure established by the driving fluid 50 will cause a disk located within a passage 52 through the lower plug 48 to rupture to therefore permit the cement 47 to be displaced through the passage 52 by continued downward movement of the apparatus 10 caused by the driving fluid 50. The cement 47 will be displaced through the cement shoe 36 and upwardly into the annulus 46 until the apparatus 10 lands on the lower plug 48. A subsequent procedure will now be described with reference to FIG. 3 of the drawings.

Figure 3:
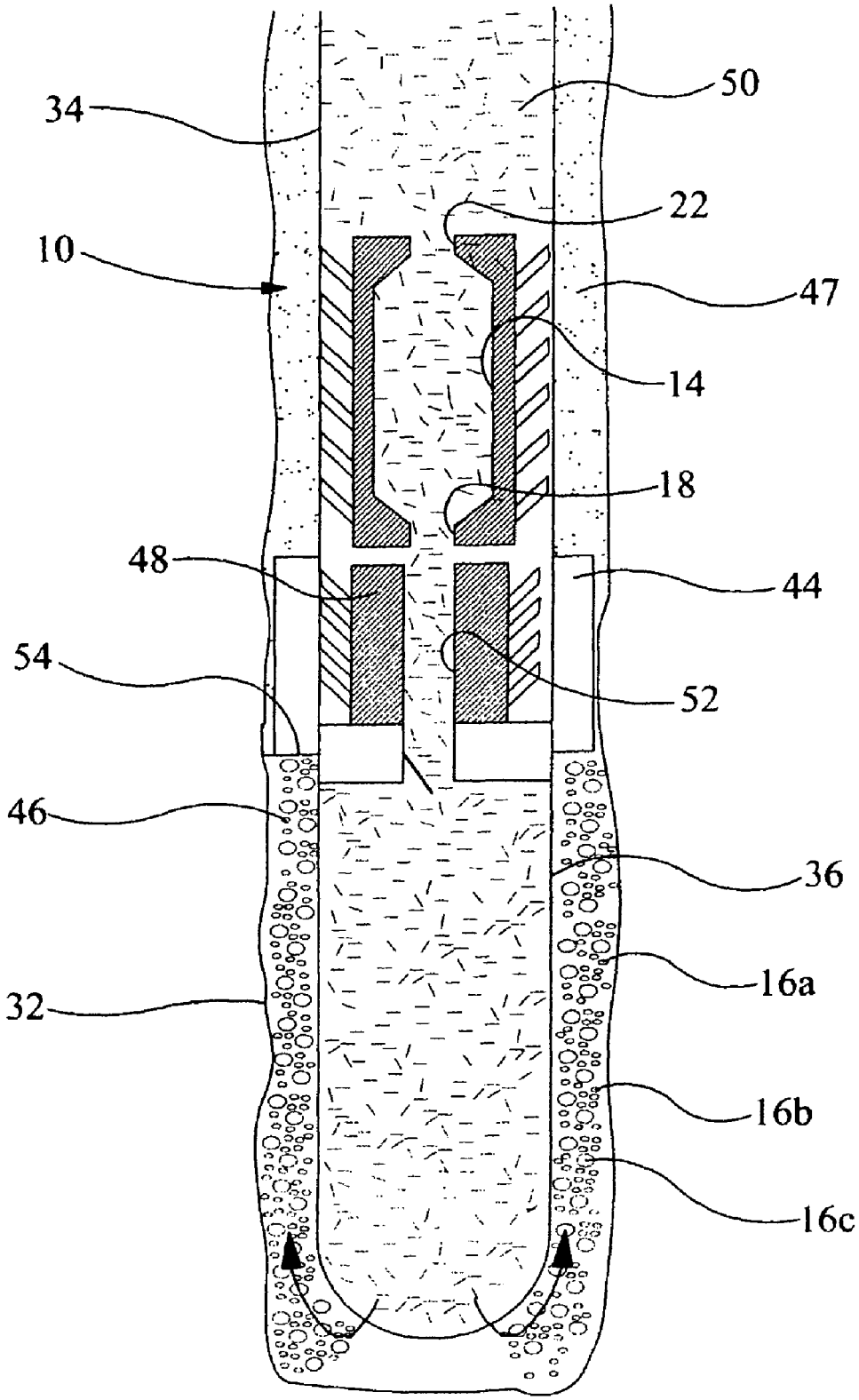
FIG. 3 is a diagrammatic representation of the apparatus of FIG. 1 in use within a wellbore.

As shown in FIG. 3, the apparatus 10 has landed on top of the lower cement plug 48. At this point the fluid pressure of the driving fluid 50 will increase and therefore rupture the upper and lower disks 24, 20 (FIG. 1) to therefore open the inlet 22 and outlet 18 of the apparatus 10. The driving fluid 50 will therefore flush or displace the swellable particles 16 from the cavity 14, through the passage 52 in the lower plug 48 and ultimately into the annulus 46. Upward movement of the particles 16 will therefore further displace the cement 47 upwardly through the annulus. Once released from the cavity 14, the swelling particles 16 may react with the appropriate activator to swell within the annulus 46 and therefore establish a robust seal in the region of the cement shoe 36. The swelling particles 16 may be activated to swell upon contact with, for example, the cement 47, other ambient wellbore fluids, the driving fluid 50 or the like.

The swollen particles 16 remain in the annulus 46 to provide a permanent sealing function. Depending on the volume of particles 16 and cement 47 displaced into the annulus 46, some or all of the particles 16 may be restrained from swelling to the maximum volume possible, and thus retain the capacity to swell further. Accordingly, there may be a degree of resilience in the annulus seal, and any subsequent shrinkage of the cement may be offset by further expansion of the particles 16.

In the embodiment shown the centralizer 44 incorporates a mesh material 54 which limits the upward displacement of the swelling particles 16 within the annulus. Due to the different grain sizes the swellable particles 16 will become arranged within the annulus 46 such that the larger grain particles 16*a* will be captured behind the mesh 54, with the medium grain sized particles 16*b* and smaller grain sized particles 16*c* being packed behind the larger grain particles 16*a*. Accordingly, this particular grading of the particles 16 assists to maintain the particles 16 within the desired location.

In other embodiments it may be desirable to reverse the arrangement of the particles, to eject the smaller particles first, followed by the larger particles. For example, ejecting smaller particles first may provide a greater degree of penetration of the particles into a water-producing formation, where it is desired to reduce or stop the volume of water production from the formation.

It should be understood that the embodiment described above is merely exemplary and that various modifications may be made thereto without departing from the scope of the present invention. For example, the apparatus may comprise drive means adapted to drive the apparatus along a suitable wellbore conduit. For example, the drive means may comprise a motor in combination with traction means, such as rotating bodies, tracks or the like. In other embodiments the apparatus may be driven to the desired location primarily or solely by gravity, or by a member which extends to surface, such as coil tubing. Additionally, the apparatus may be of any suitable size to contain the required volume or quantity of material to be delivered into the wellbore. Furthermore, a plurality of apparatuses according to the present invention may be used in combination in order to deliver the required quantity of material into the wellbore, or to deliver a variety of materials into a wellbore, or to deliver materials to a variety of positions in the wellbore. It should also be understood that the apparatus of the present invention may be utilized to deliver any material into the wellbore, and is not restricted to delivering a swellable material. For example, the apparatus may be adapted to deliver a cement mixture, chemical composition, explosive mixture or the like, and may contain more than one material, for example a bi-component material adapted to mix as the materials are displaced from the apparatus. Additionally, the apparatus may further comprise a piston arrangement adapted to displace or eject the material from within the cavity. In this arrangement the piston may be actuated by the fluid utilized to drive the apparatus through the cavity, and may also serve to permit pressure equalization between the cavity and the surrounding well fluid.

In some embodiments a volume of cement or other sealing material may be displaced into the annulus after the material which has been delivered by the apparatus. The additional sealing material may be utilized to retain the delivered material in place.

The embodiments of the invention described above are primarily intended to be pumped through tubing to a desired location. However, in other embodiments the apparatus may comprise tubing forming part of a tubing string, for example casing or liner joints which are filled or part filled with material and then run into the bore. Thus, large volumes of material may be delivered to a desired location, which may or may not coincide with the final location of the tubing. The ability to deliver large volumes of material may facilitate the filling and sealing of long sections of annulus, and in some instances may permit swelling materials to replace the conventional cement as the sealing material. The tubing joints may be pre-filled off site, or may be filled on-site, for example by "top-filling" as the tubing is made up. The material may be provided in any appropriate form, for example as a slurry or free-flowing powder, or in granular form. The material may be provided "loose" and conveyed pneumatically, by pumping or by gravity. Alternatively, the material may be bagged or wrapped to facilitate transport and storage and manual handling or movement by crane or pulley.

Figure 4:
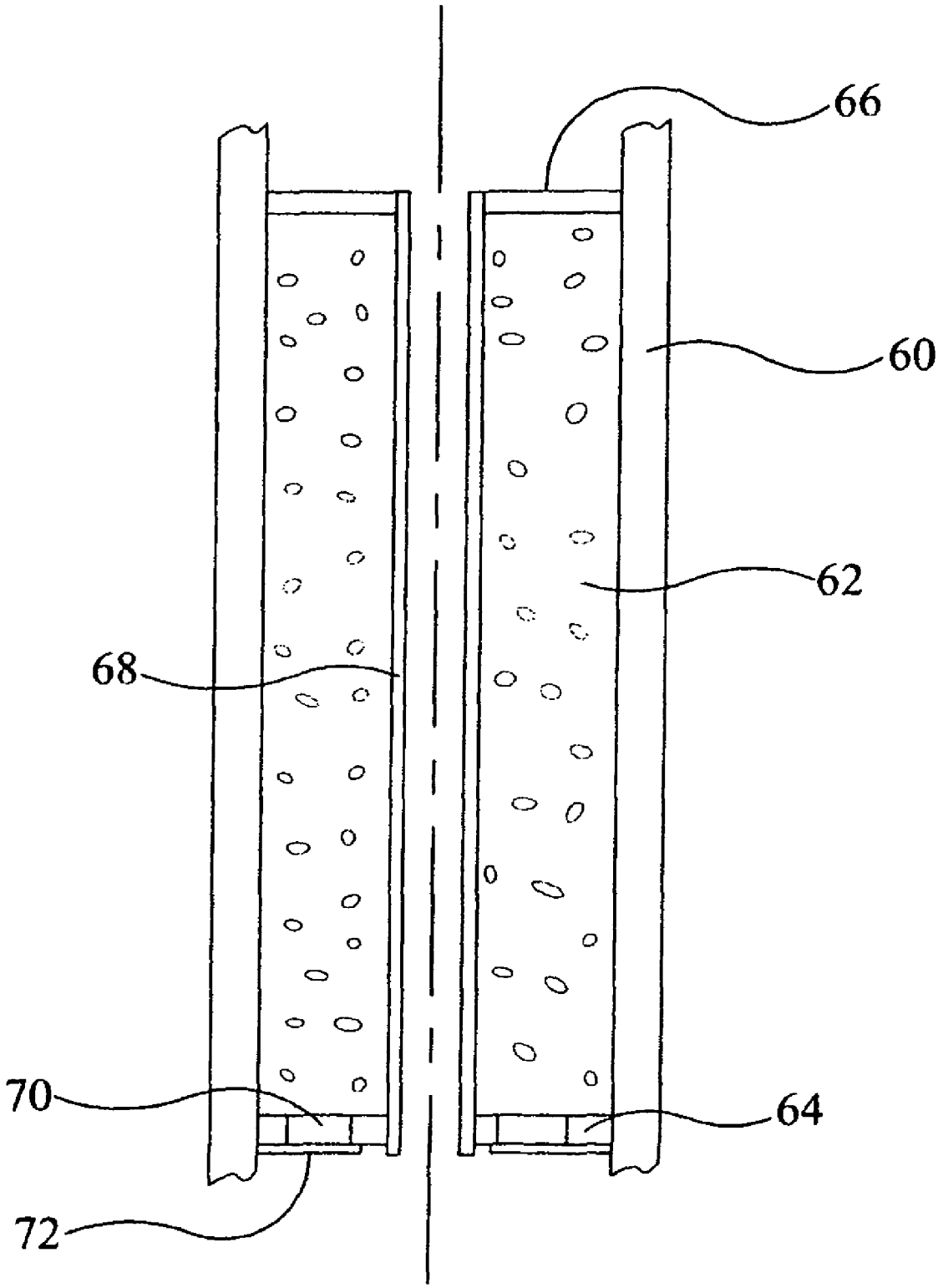
FIG. 4 is a diagrammatic cross-sectional view of an apparatus according to a further embodiment of the present invention.

FIG. 4 of the drawings illustrates an embodiment of this aspect of the invention in which section of tubing 60 contains a volume of swelling material 62 comprising water-swellable rubber particles. A lower disc 64 and an upper piston 66 initially isolate the swelling material 62 from surrounding fluid. To permit passage of fluid through the tubing a tube 68 extends between the piston 66 and the disc 64.

The tubing 60 may be run into a bore on a tubing string until the tubing 60 is at a desired location in the bore. If a dart or ball is then pumped down the string to close the upper end of the tube 68, an elevated fluid pressure may be applied to the upper face of the piston 66. This pressure forces the piston 66 to move downwards through the tubing 60, and forces the swelling material 62 out through ports 70 provided with one-way valves 72 in the disc 64. The swelling material 62 may then pass, for example, through ports in a shoe into an annulus surrounding the tubing 60. The swelling material 62 may then be exposed to a suitable activator, such as water or oil, and will swell to fill and seal the annulus.

Thus, a desired volume of swelling material 62 may be delivered to a particular location in a bore while isolated from ambient fluid.

The parts of the apparatus remaining in the tubing 60 after the swelling material 62 has been displaced, namely the disc 64, piston 66 and tube 68, may be retrieved by a fishing operation, be drilled or milled out, or may remain in place in the tubing 60.

It is a further advantage of the embodiments of the present invention utilizing swelling materials that the volume of material that must be delivered is likely to be significantly less than the volume to be filled by the swollen material. Current swelling materials may swell up to 700% of their original volume, such that one barrel (bbl) of swelling material may swell to occupy seven bbl. This is in sharp contrast to conventional sealing materials, such as cement, which tend to shrink while setting.

In addition to the primary cementing and sealing operations described above, the various aspects of the invention may also have utility in secondary sealing or cementing applications, for example for delivering materials for use in cement squeeze operations.

Although the above description has focused primarily on downhole applications, embodiments of the invention may be utilized in other applications, such as risers, pipelines, ducting, and indeed in any form of conduit or tubing.

The invention claimed is:

1. An apparatus for delivering a swellable material into a wellbore, said apparatus comprising:

a body adapted to be driven along a conduit within a wellbore by a driving fluid;

a swellable material having a first form in which the material occupies a first volume and a swollen second form in which the material occupies a larger second volume;

a cavity in the body containing the swellable material in the first form;

an outlet adapted to be selectively opened to permit the swellable material to be released from the cavity and subsequently swell to the second form: and an inlet to permit access into the cavity wherein the inlet is adapted to be selectively opened to permit access to the cavity and wherein the inlet is adapted to permit fluid from a wellbore to enter the cavity to displace the material from the cavity through the outlet.

2. The apparatus of claim 1, wherein the apparatus includes at least one resilient member extending from the outer surface of the body, wherein said resilient member is adapted to engage an inner surface of the wellbore conduit within which the apparatus is to be used.

3. The apparatus of claim 1, wherein the outlet is adapted to be opened in response to an applied force or pressure.

4. The apparatus of claim 1, wherein the outlet is adapted to eject the material from the cavity in response to a predetermined condition.

5. The apparatus of claim 1, wherein the inlet is adapted to permit a driving fluid, used to drive the apparatus along a wellbore conduit, to communicate with the cavity and displace the material from the cavity through the outlet.

6. The apparatus of claim 1, wherein at least one of the outlet and an inlet to the cavity is provided with a removable barrier.

7. The apparatus of claim 1, including a pressure compensator adapted to substantially equalize the pressure of the cavity with the pressure within the wellbore conduit.

8. The apparatus of claim 1, wherein the apparatus is adapted to be located at a required location within a wellbore conduit by engagement with a restriction within the conduit.

9. The apparatus of claim 8, wherein the apparatus is adapted to be driven through a wellbore conduit by a driving fluid, wherein engagement of the apparatus with a restriction within the conduit will affect an increase in the pressure of the driving fluid, the increase in pressure causing release of the material.

10. The apparatus of claim 1, wherein the swellable material comprises at least one of: a fluid; slurry; foam, and swelling particles.

11. The apparatus of claim 1, wherein the swellable material is initially isolated from wellbore fluids.

12. The apparatus of claim 1, wherein the apparatus is provided in combination with a wellbore barrier adapted to retain the swellable material in a desired location within the wellbore when the material is released from the cavity.

13. The apparatus of claim 1, wherein the apparatus is adapted for use as a cement plug.

14. A method of delivering a material into a wellbore, said method comprising the steps of:

providing an apparatus having a body and defining a cavity;

loading a swellable material into the cavity, the material being in a first form and occupying a first volume;

locating the apparatus in a wellbore conduit and driving said apparatus through the wellbore conduit using a driving fluid to a required location within the conduit;

releasing the material from the cavity, whereby the material may subsequently swell to a second form and occupy a larger second volume; and exposing the material to a swelling activator.

15. The method of claim 14, including releasing the material from the cavity through an outlet.

16. The method of claim 14, including utilizing fluid pressure to release the material from the cavity.

17. The method of claim 14, wherein the method includes the step of translating the apparatus through a wellbore conduit until engagement with a restriction within the conduit.

18. The method of claim 17, including the step of releasing the material from the cavity subsequent to engagement of the apparatus with the restriction.

19. The method of claim 14, including releasing the material and displacing the material into an annular area formed within the wellbore.

20. The method of claim 14, wherein the material being delivered is a water-swellable material.

21. The method of claim 14, including loading swellable particles of different sizes into the cavity.

22. The method of claim 21, comprising loading swellable particles within the cavity such that particles of larger size are released first, followed by smaller particles.

23. A method of sealing a conduit within a wellbore, said method comprising the steps of:

providing an apparatus having a body and a cavity in the body;

loading a swellable sealing material in the cavity, the material being in a first form occupying a first volume;

locating the apparatus within a conduit in a wellbore and translating said apparatus to a required location within the conduit; and releasing the sealing material from the cavity and displacing the material into an annulus formed between the conduit and the wellbore where the material swells to a second form occupying a larger second volume.

24. The method of claim 23, wherein the sealing material is adapted to form a permanent seal in the annulus.

25. The method of claim 23, wherein the method includes the step of displacing the swellable sealing material into the annulus and then activating the swellable sealing material to swell to establish a seal within said annulus.

26. The method of claims 23, including introducing a volume of cement into the conduit and displacing the cement through the conduit, wherein the cement is displaced into the annulus between the conduit and the wellbore.

27. The method of claim 26, wherein the sealing material is released from the cavity and displaced into the annulus to be activated to form a seal in conjunction with the cement.

28. An apparatus for delivering a swellable material into a wellbore, said apparatus comprising:

a body adapted to be driven along a conduit within a wellbore by a driving fluid;

a swellable material having a first form in which the material occupies a first volume and a swollen second form in which the material occupies a larger second volume wherein the swellable material comprises a water-swellable rubber;

a cavity in the body containing the swellable material in the first form; and an outlet adapted to be selectively opened to permit the swellable material to be released from the cavity and subsequently swell to the second form.

29. An apparatus for delivering a swellable material into a wellbore, said apparatus comprising:

a body adapted to be driven along a conduit within a wellbore by a driving fluid;

a swellable material having a first form in which the material occupies a first volume and a swollen second form in which the material occupies a larger second volume wherein the swellable material comprises swellable particles of different sizes;

a cavity in the body containing the swellable material in the first form; and an outlet adapted to be selectively opened to permit the swellable material to be released from the cavity and subsequently swell to the second form.

30. The apparatus of claim 29, wherein the particles are provided in regions of particles of common size within the cavity.

31. The apparatus of claims 30, wherein the swellable particles are graded such that larger particles are first ejected from the outlet, followed by smaller particles.

32. An apparatus for delivering a swellable material into a wellbore, said apparatus comprising:

a body adapted to be driven along a conduit within a wellbore by a driving fluid;

a swellable material having a first form in which the material occupies a first volume and a swollen second form in which the material occupies a larger second volume;

a cavity in the body containing the swellable material in the first form;

an outlet adapted to be selectively opened to permit the swellable material to be released from the cavity and subsequently swell to the second form; and wherein the apparatus is adapted to be translated through a wellbore conduit in conjunction with a volume of cement which is displaced through the wellbore conduit and into a wellbore annulus.

* * * * *